United States Patent [19]

Furuya et al.

[11] Patent Number: 4,645,419

[45] Date of Patent: Feb. 24, 1987

[54] CENTRIFUGAL COMPRESSOR

[75] Inventors: Tai Furuya, Kanagawa; Keiji Koike, Tokyo, both of Japan

[73] Assignee: Ebara Corporation, Tokyo, Japan

[21] Appl. No.: 764,746

[22] Filed: Aug. 12, 1985

[30] Foreign Application Priority Data

Sep. 10, 1984 [JP] Japan ..... 59-188164
Sep. 12, 1984 [JP] Japan ..... 59-189660

[51] Int. Cl.[4] ..... F04D 29/42

[52] U.S. Cl. ..... 415/210; 415/211; 415/219 A

[58] Field of Search ..... 415/208, 181, 209, 210, 415/211, 219 A, 182

[56] References Cited

U.S. PATENT DOCUMENTS

| | | | |
|---|---|---|---|
| 2,419,669 | 4/1947 | Birmann | 415/209 X |
| 2,898,031 | 8/1959 | Voigt | 415/219 A |
| 3,390,545 | 7/1968 | Hoffman | 415/219 A |
| 3,552,877 | 1/1971 | Christ et al. | 415/209 |
| 4,548,545 | 10/1985 | Lewis et al. | 415/209 X |

FOREIGN PATENT DOCUMENTS

| | | | |
|---|---|---|---|
| 937987 | 9/1963 | United Kingdom | 415/219 A |

OTHER PUBLICATIONS

Gaylord O. Ellis—"*Journal of Basic Engineering*" Mar. 1960, pp. 155–168.

*Primary Examiner*—Robert E. Garrett
*Assistant Examiner*—Joseph M. Pitko
*Attorney, Agent, or Firm*—Oblon, Fisher, Spivak, McClelland & Maier

[57] ABSTRACT

A centrifugal compressor having an improved efficiency is constructed by providing a diffusion channel and vanes downstream of a diffuser, the diffusion channel being coupled to the diffuser through a U-turn channel, the outlet side passage of the U-turn channel being made larger than the inlet side passage and the kinetic energy being recovered at the diffusion channel. Further improvement is achieved by providing guide vanes in the U-turn channel.

5 Claims, 11 Drawing Figures

CENTRIFUGAL COMPRESSOR

FIELD OF THE INVENTION

The present invention relates to a centrifugal compressor and more particularly to such a compressor wherein the efficiency thereof is improved by efficiently recovering kinetic energy of fluid passed through the impeller.

BACKGROUND OF THE INVENTION

Heretofore, in a centrifugal compressor either in a single stage type or a multi-stage type, kinetic energy of fluid given by an impeller is recovered at a diffuser by decreasing the fluid velocity while increasing the fluid pressure. However, the fluid still possesses the kinetic energy after passing the diffuser, and such remaining kinetic energy of fluid at a diffuser outlet is recovered at a volute chamber provided downstream of the diffuser outlet in a single stage compressor, or downstream of the diffuser in the last stage in the case of a multi-stage compressor. If the dimension in the flowing direction of the diffuser is made large enough, the remaining kinetic energy of the fluid just upstream of the volute chamber would become small whereby sudden expansion loss and friction loss in the volute chamber would also become small. However, such an attempt to increase the flowing passage length of the diffuser would result in an increase in the total size of the compressor which may not be economical and would cause difficulty in terms of designing such construction in the compressor. For this reason the most practical approach in the art has been to make the compressor compact.

However, if the compressor is made compact, the sudden expansion loss becomes especially large at the portion where the fluid enters the volute chamber or collector from the diffuser outlet and the friction loss also becomes large since the distance which the fluid flows in the volute chamber until it is discharged to an outlet conduit from the compressor is relatively long so that the efficiency of the compressor is degraded.

Therefore, it has been desired to have a compressor having an improved efficiency without involving substantial increase in the size of the compressor.

OBJECTS OF THE INVENTION

Accordingly, it is an object of the present invention to provide a centrifugal compressor the efficiency of which is greatly improved without substantially increasing the dimension of the compressor.

It is also an object of the present invention to provide an improved energy recovering means for a centrifugal compressor.

SUMMARY OF THE INVENTION

These objects are achieved by the present invention.

A centifugal compressor constructed in accordance with the present invention is provided with a diffusion channel somewhat similar to a return channel employed in a multi-stage centrifugal compressor, the diffusion channel being disposed downstream of a diffuser and coupled with the diffuser by means of a U-turn channel. The diffusion channel is provided with a plurality of guide vanes to direct fluid through the channel toward a collector formed in the shape of a volute chamber. The U-turn channel changes the direction of fluid flow by 180°, and its outlet side communicating with the diffusion channel is made larger with respect to its flowing passage width than that of its inlet side which communicates with the diffuser outlet. The kinetic energy of the flowing fluid is effectively converted to pressure at the diffusion channel.

In one mode of the embodiments of the present invention, a plurality of guide vanes are also provided on the inner wall of the U-turn channel whereby the U-turn channel also contributes to improvement of the compressor efficiency.

Further objects and advantages of the present invention will be clarified by the ensuing description which follows the brief explanation of drawings summarized below.

DETAILED DESCRIPTION OF THE PREFERRED EMBODIMENTS

Before describing the present invention, some brief description regarding the prior art would be helpful in reaching an understanding of the present invention.

Figure 1A:
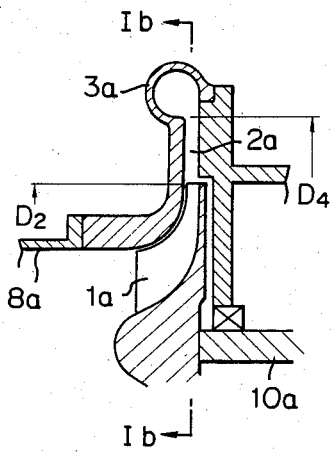
Fig. 1a PRIOR ART
FIG. 1*a* is a sectional view of a part of a conventional centrifugal compressor sectioned in a meridian plane.
Figure 1B:
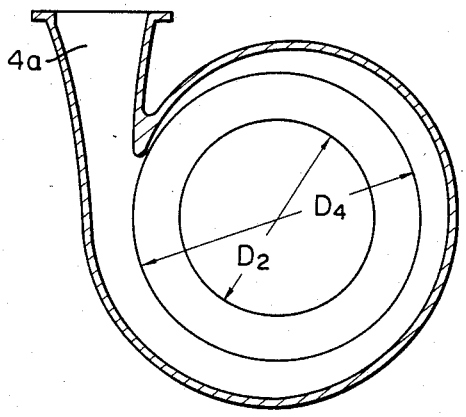
Fig. 1b PRIOR ART
FIG. 1*b* is a cross sectional view taken along the line I*b*—I*b* in FIG. 1*a;*

Schematically shown in FIGS. 1*a* and 1*b* are illustrations of a conventional centrifugal compressor respectively drawn as a meridian cross section and a cross section vertical to an impeller axis. When an impeller 1*a* is driven through a shaft 10*a*, a fluid is sucked into a compressor from an intake opening 8*a* with the fluid being pressurized and given kinetic energy by the impeller. Such fluid is directed to a diffuser 2*a* where the kinetic energy is recovered by reducing the velocity of the fluid to raise the pressure. The fluid passing the diffuser 2*a* still retains velocity and such remaining kinetic energy is further recovered by volute chamber 3*a*, while passing through approximately 360° of the circumferential passage of the chamber 3*a*, and thereafter the fluid is directed to an exhaust port 4*a* which is coupled to a delivery duct. In this case, the dimension of the diffuser is defined by $$(D_4-D_2)/2$$

wherein $D_2$ is an outer diameter of the impeller 1*a;* and $D_4$ is a diameter for a circle corresponding to the exhaust end of the diffuser 2*a*.

As explained in the foregoing, the idea of increasing the diffuser length in order to improve the efficiency is not appropriate.

In another aspect, the present invention employs a construction somewhat similar to a return channel of a multi-stage centrifugal compressor. Thus, some further brief explanation is given below regarding such return channel of a multi-stage centrifugal compressor.

Figure 2:
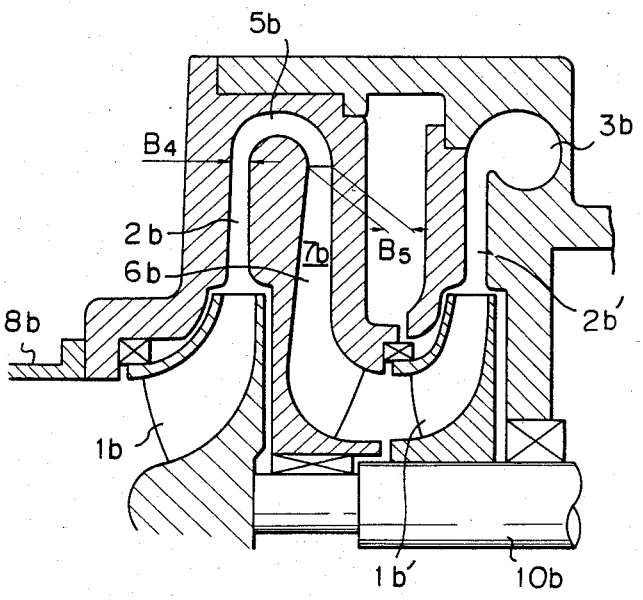
Fig. 2 PRIOR ART
FIG. 2 is a cross sectional view of a part of a conventional multi-stage centrifugal compressor taken along a meridian plane.
Figure 3A:
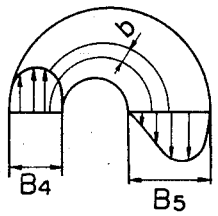
FIGS. 3*a* and 3*b* show a velocity distribution and a flow angle distribution at a U-turn channel, respectively.

In FIG. 2, a conventional multi-stage centrifugal compressor is schematically illustrated by its meridian cross-section. In this case, impellers 1*b* and 1*b'* are installed on a rotary shaft 10*b*. Upon rotation of the shaft 10*b*, the impeller 1*b* sucks fluid through an intake opening 8*b*. The fluid is then directed to a diffuser 2*b*, a U-turn channel 5*b* and a return channel 6*b* provided with return vanes 7*b*. The fluid is thence directed to a second impeller 1*b'*. The fluid is further directed to a volute chamber 3*b* through a second diffuser 2*b'*. In the compressor of this type, some consideration is applied to the recovery of kinetic energy from the fluid that has passed the diffuser 2*b* such as by arranging the width of the fluid passage at the U-turn channel 5*b* to be equal to the width of the discharge portion of the diffuser 2*b* or by making the width of the discharge side end of the U-turn channel 5*b* to be slightly broader for the purpose of reducing the velocity of the fluid. However, with such arrangement, the U-turn channel 5*b* merely deflects the meridianal flowing direction 180° and so no substantial recovery of kinetic energy is expected by this U-turn channel 5*b*. Furthermore, since the width of the flow passage in the return channel 6*b* is so narrow as to be almost equivalent to that of the diffuser 2*b*, the U-turn channel 5*b* and the return channel 6*b* cause a relatively large friction loss and, thus, a relatively large total pressure loss, thereby degrading the compressor efficiency. If the width of the flow passage in the return channel 6*b* is increased compared to that of the diffuser 2*b* in order to reduce the friction loss, the width of the U-turn channel 5*b* is necessarily enlarged to allow smooth connection with the enlarged return channel 6*b*. Thus, the velocity distribution in the U-turn channel would become such as is shown in FIG. 3*a* wherein $B_4$ corresponds to the width of the flow passage at the outlet of the diffuser 2*b* and $B_5$ corresponds to the width of the flow passage at the inlet of the return channel 6*b*. As seen from FIGS. 3*a* and 3*b*, it was experimentally recognized that if the relationship of $$B_5 > B_4$$

is established, meridian velocity distribution shows greater velocity at the outer wall side than that at the inner wall side at the outlet of the U-turn channel 5*b* and the flow angle of the fluid velocity (which is defined relative to the circumferential direction) is smaller in the inner wall side than the outer wall side at the outlet of the U-turn channel 5*b*.

In this case of FIG. 3*a*, a pressure recovery factor $C_p$ from the inlet to the outlet will now be reviewed employing the following symbols.

C: absolute velocity
Cm: meridian velocity
p: static pressure
$P_T$: total pressure
$\rho$: density of fluid
b: distance between any adjacent stream lines at the U-turn channel
$\xi_u$: total pressure loss coefficient.

The suffixes "4" and "5" for the above symbols designate the respective values at the inlet and outlet. Then the following equations are given $$\xi_u = \frac{P_{T4} - P_{T5}}{(\rho/2)C_4^2}$$

$$C_p = \frac{p_5 - p_4}{(\rho/2)C_4^2}$$

Also, the following equations are established.

$$P_{T4} = p_4 + (\rho/2)C_4^2$$

$$P_{T5} = p_5 + (\rho/2)C_5^2$$

$$b_4 \cdot Cm_4 = b_5 \cdot Cm_5$$

$$Cm_4 = C_4 \sin \alpha_4$$

$$Cm_5 = C_5 \sin \alpha_5$$

wherein $\alpha_4$ and $\alpha_5$ are angles of flow direction relative to the circumferential or tangential direction at the inlet and outlet of the U-turn channel 5*b*. Accordingly, Cp is expressed by the following equation.

$$Cp = 1 - \left(\frac{b_4}{b_5} \cdot \frac{\sin \alpha_4}{\sin \alpha_5}\right)^2 - \xi_u$$

Therefore, if the value of $$\frac{b_4}{b_5} \cdot \frac{\sin \alpha_4}{\sin \alpha_5}$$

becomes smaller, the value of Cp becomes larger and if such condition is achieved, the U-turn channel 5*b* may contribute to achieving an effect similar to that of the diffuser.

Figure 3B:
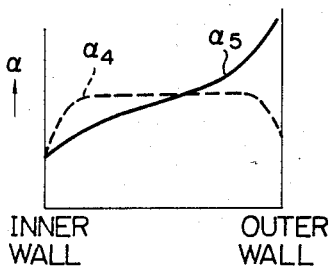

However, as explained above, at the outlet of the U-turn channel 5*b*, the mass flow rate corresponding to meridian velocity tends to lean to the outer wall side and the distribution of the flow angle shows, as illustrated in FIG. 3*b*, a larger angle at the outer wall side and a smaller angle at the inner wall side. Therefore, at the inner wall side, the following relationship is observed, namely, $b_5 > b_4$; and
$\sin \alpha_5 < \sin \alpha_4$ while at the outer wall side $b_5 < b_4$; and
$\sin \alpha_5 > \sin \alpha_4$.

Accordingly, there will be no substantial difference between the inner wall side and the outer wall side with respect to the value of $$\frac{b_4}{b_5} \cdot \frac{\sin \alpha_4}{\sin \alpha_5}.$$

This situation indicates that the flow angle at the outlet of the U-turn channel (that is, at the inlet of the return channel) is not uniform and, thus, means adapted for merely making the inlet and outlet relation as $$B_5 > B_4$$

will not provide an effective diffuser.

Keeping in mind the foregoing drawbacks discussed with respect to the prior art, the present invention will now be explained.

The inventors of the present invention conceived the idea of utilizing a diffusion channel somewhat similar to the return channel employed in a multi-stage compressor. To such end, a diffusion channel is provided downstream of a diffuser a centrifugal compressor by providing a U-turn channel between the diffuser and the diffusion channel. Further, a collector is provided downstream of the diffusion channel.

Figure 4:
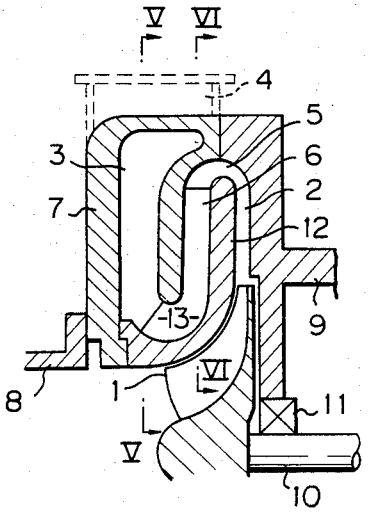
FIG. 4 is a cross sectional view of a part of a centrifugal compressor according to the present invention.

Referring to FIG. 4, a partial cross sectional view of a centrifugal compressor according to the present invention taken in a meridian plane is shown.

Figure 5:
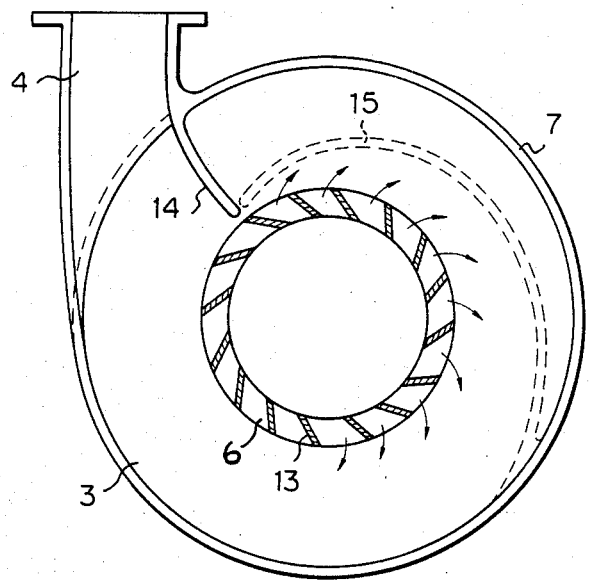
FIG. 5 is a cross sectional view taken along the line V—V in FIG. 4.

An impeller 1 is mounted on a shaft 10 which is rotatably supported by a bearing and sealing means 11 mounted in a compressor body casing 9. Downstream of the impeller 1, a diffuser 2 is formed by the casing 9 and a separating plate member or diaphragm 12. Connected to the outlet of the diffuser 2, a diffusion channel 6 is formed by the member 12 and a part of a casing 7 attached to the body casing 9 with a U-turn channel 5 formed between the channel 6 and the diffuser 2. Within the channel 6, a plurality of vanes 13 are disposed in a manner similar to that of a return vane in a return channel of a multi-stage centrifugal compressor. Downstream of the channel 6 is disposed a collector 3, the flow passage of which is lead to a discharge port 4 (FIG. 5) smoothly and tangentially coupled to the collector 3. Upstream of the impeller 1 is disposed a suction opening 8.

Upon rotation of the shaft 10, fluid is sucked through the opening 8 by the impeller 1 and thence directed to the diffuser 2, where the velocity of the fluid is decreased and the kinetic energy thereof is converted to raise the pressure. The fluid is then passed through the U-turn channel 5 to change by 180° the outwardly flowing direction to the inwardly flowing direction, and the fluid is further passed through the diffusion channel 6 having the vanes 13 therein. The remaining kinetic energy in the fluid at the outlet of the diffuser 2 is further recovered at the channel 6 and the fluid is discharged to the collector 3. As seen from FIGS. 4 and 5, the collector 3 is adapted to collect the fluid discharged from the channel 6 while still retaining some whirling velocity, and thence to direct the fluid to the discharge port 4. Compared to the conventional compressor illustrated in FIGS. 1*a* and 1*b*, the velocity of the fluid entering into the collector 3 is already decreased sufficiently and, therefore, the sudden expansion loss and friction loss are made relatively small in the case of the compressor shown in FIGS. 4 and 5.

Figure 6:
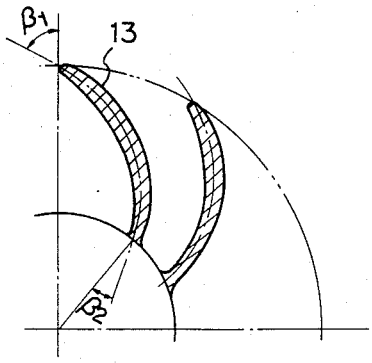
FIG. 6 is a cross sectional view of a part sectioned along the line VI—VI in FIG. 4.

In order to smoothly guide the fluid discharged from the channel 6 through the collector 3 to the discharge port 4, it is preferable that some velocity in the whirling direction is still retained in the discharged fluid at the outlet of the channel 6. To such end, as shown in FIG. 6, each vane 13 is given an outlet vane angle of $\beta_2$ relative to the radial direction. The value of the angle $\beta_2$ is preferably in the range of 20°–30°. An angle $\beta_1$ is an inlet angle of each vane 13 also defined relative to the radial direction.

Regarding the collector 3, it is preferable for the cross sectional area traversing the flow to be gradually increased towards the discharge port 4. Such increase may be accomplished by such steps as gradually increasing the radial dimension or the axial dimension, or both in combination. With such gradual increase in the collector or volute chamber 3, sudden expansion loss may be reduced and the collector 3 becomes to have high efficiency. At the portion near the discharge port 4, a guide vane 14 is provided so as to smoothly guide the fluid that has passed the collector 3 towards the discharge port 4. Also, within the collector 3, it is possible to provide a guide vane 15 (FIG. 5) in order to meet the gradual increase of the dimension of the passage.

With the arrangement explained above, a compressor having high efficiency is provided.

Figure 7:
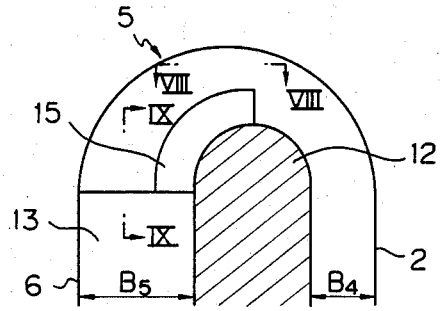
FIG. 7 is an enlarged partial view of the U-turn channel shown in FIG. 4.
Figure 8:
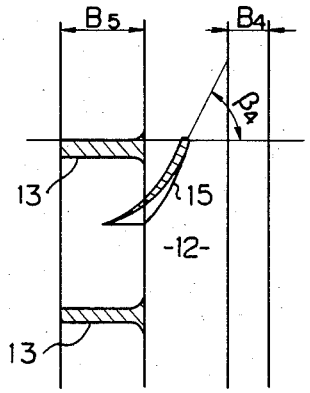
FIG. 8 is a view of the portion seen by looking in the direction of arrows VIII—VIII in FIG. 7.
Figure 9:
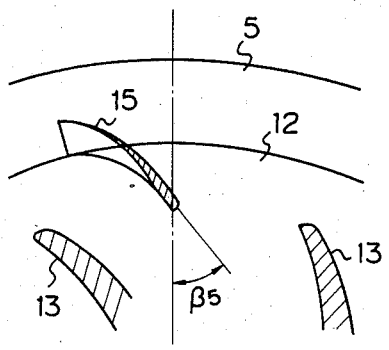
FIG. 9 is a view of the portion seen by looking in the direction of arrows IX—IX in FIG. 7.

Further improvement may be achieved when the fluid flow in the U-turn channel is considered in relation to the value of $$\frac{b_4}{b_5} \cdot \frac{\sin \alpha_4}{\sin \alpha_5}$$

which was discussed before with reference to FIGS. 3*a* and 3*b*. In the present invention, the dimension $B_5$ (outlet side width of the U-turn channel 5) is made larger than the dimension $B_4$ (outlet width of the diffuser 2), but mere provision of such an arrangement may not improve the efficiency, as already explained above. In this connection, a part of the U-turn channel 5 of FIG. 4 is schematically shown in FIG. 7 in an enlarged scale. In FIG. 7, it is noted that a plurality of guide vanes 15 are provided along the inner wall of the U-turn channel 5 on the separating member or diaphragm 12 at the outlet side of the channel 5. The height of the vane 15 is smaller than the width of the flow passage of the U-turn channel 5. The pupose of the vanes 15 is to avoid any decrease in the flow angle at the inner wall side of the outlet side of the U-turn channel 5 as well as to increase the value of $\sin \alpha_5$, whereby the value of $$\frac{b_4}{b_5} \cdot \frac{\sin \alpha_4}{\sin \alpha_5}$$

is decreased to effectively raise the pressure in the U-turn channel 5. Views in the directions VIII—VIII and IX—IX in FIG. 7 are shown in FIG. 8 and FIG. 9, respectively. The purpose of providing the guide vanes 15 is to change the flow angle at the inner side wall of the U-turn channel 5 and, thus, it is unnecessary to make their height any higher. Also the angle $\beta$ relative to the meridian direction is preferably decreased from the upstream side ($\beta_4$) to the downstream side ($\beta_5$). Making such an increase in the opposite direction (that is, to increase the angle from the inlet angle $\beta_4$ to the outlet angle $\beta_5$) would be meaningless.

With the provision of the guide vanes 15, the pressure rise at the inner wall side of the U-turn chanhel 5 is increased, and the flow angle at the outlet of the U-turn channel 5 is unified. Also, it is made possible for the passage width of the diffusion channel to have a greater width, whereby decrease in the velocity and friction loss are to be expected. While the guide vane 15 is illustrated in FIGS. 7, 8 and 9 as extending 90° around the radial end of the diaphragm 12 or along the inner wall of the U-turn channel 5 at the side adjacent the inlet of the diffusion channel 6, it may extend 180° for the full length of the U-turn channel 5, or it may be disposed in the intermediate portion between the outlet of the diffuser and the inlet of the diffusion channel.

The present invention has been explained in detail by referring to the specific embodiments. However, the present invention is not limited to what has been explained, and it may be modified or changed by those skilled in the art within the sprit and scope of the present invention defined in the claims appended hereto.

What is claimed is:

1. A centrifugal compressor comprising:

(a) a casing;

(b) an impeller mounted on a rotatable shaft within said casing;

(c) a diffuser disposed within said casing downstream of said impeller;

(d) a diffusion channel disposed within said casing downstream of said diffuser;

(e) a plurality of first guide vanes disposed in said diffusion channel;

(f) a U-turn channel connecting said diffuser and said diffusion channel for conducting fluid from said U-turn channel being broader at its outlet than at its inlet;

(g) a collector in the form of a volute chamber, a flowing passage thereof being coupled to the outlet of said diffusion channel and terminating at a discharge port; and (h) a plurality of second guide vanes disposed in said U-turn channel on the inner side wall thereof, each one of said plurality of second guide vanes having a height shorter than the width of the flow passage of said U-turn channel and each one of said plurality of second guide vanes extending in a direction along the flowing direction with an inclination relative to the meridian direction such that the outlet angle thereof is smaller than the inlet angle thereof.

2. A centrifugal compressor as claimed in claim 1 wherein each one of said plurality of second guide vanes is disposed between the inlet end and the outlet end of said U-turn channel over an angular range of 90°–180°.

3. A centrifugal compressor as claimed in claim 2 wherein each one of said plurality of first vanes is inclined by an angle of 20°–30° relative to the radial direction at the outlet of said diffusion channel.

4. A centrifugal compressor as claimed in claim 2 wherein the flowing passage of said collector is gradually increased in its cross section normal to the flow direction from the starting position of said flowing passage of said collector toward said discharge port.

5. A centrifugal compressor as claimed in claim 1 wherein said discharge port is tangentially connected to said flow passage of said collector.

* * * * *